US005876235A

United States Patent [19]

Yoshigi

[11] Patent Number: 5,876,235

[45] Date of Patent: Mar. 2, 1999

[54] CONNECTOR MOUNTING STRUCTURE

[75] Inventor: Toshimasa Yoshigi, Shizuoka-ken, Japan

[73] Assignee: Yazaki Corporation, Tokyo, Japan

[21] Appl. No.: 837,096

[22] Filed: Apr. 14, 1997

[30] Foreign Application Priority Data

Apr. 15, 1996 [JP] Japan ..... 8-092606

[51] Int. Cl.[6] ..... H01R 13/648

[52] U.S. Cl. ..... 439/384

[58] Field of Search ..... 439/382–384, 439/552, 553, 247, 248

[56] References Cited

U.S. PATENT DOCUMENTS 4,894,018 1/1990 Phillips et al. ..... 439/81

5,131,867 7/1992 Peloza et al. ..... 439/384

*Primary Examiner*—Gary F. Paumen

*Attorney, Agent, or Firm*—Finnegan, Henderson, Farabow, Garnett & Dunner, L.L.P.

[57] ABSTRACT

A connector mounting structure having a case mounted on the automatic transmission unit 20 for containing one or a multiplicity of connectors is disclosed, in which at least one vibration-absorbing elastic member is interposed in contact between the case and the automatic transmission unit. The elastic member is made of a resin spring integrally formed with the resin case. The vibrations exerted on the connectors from the automatic transmission unit can thus be reduced and the adverse effect of the vibrations on the connectors is minimized.

3 Claims, 3 Drawing Sheets

CONNECTOR MOUNTING STRUCTURE

BACKGROUND OF THE INVENTION

The present invention relates to a structure for mounting a connector for connecting an electrical part (such as a solenoid valve) of an automatic transmission unit of an automobile, for example, and a wire harness to the automatic transmission unit.

The automatic transmission unit of the automotive vehicle is normally equipped with a solenoid valve for controlling the oil pressure. The solenoid valve is conventionally connected to the wire harness of the vehicle body, for example, by a connector mounted on the automatic transmission unit.

The automatic transmission unit, however, is a source of vibrations which are transmitted to and are liable to adversely affect the connector.

SUMMARY OF THE INVENTION

In view of the above-mentioned situation, the object of the present invention is to provide a connector mounting structure, in which the vibrations exerted on the connector from the automatic transmission unit are reduced and the adverse effect of the vibrations on the connector is minimized.

In order to achieve the above-mentioned object, according to the present invention, there is provided a connector mounting structure comprising a case having a connector for electrical connection and mounted on an onboard unit, and an elastic member interposed in contact between the case and the onboard unit for absorbing the vibrations.

With this structure, the vibrations transmitted from the onboard unit can be absorbed by the elastic member. As a result, less vibrations are transmitted to the connector so that the connector is protected from the vibrations considerably, thereby reducing the adverse effect of the vibrations. The reliability of electrical connection of the connector thus is improved.

Also, the case is made of a resin mold, and the elastic member can be a resin spring integrated with the case.

With this structure, the elastic member constitutes a resin spring integrated with the case, and therefore the elastic member need not be handled as an independent part. The number of parts can thus be reduced while at the same time reducing the labor of the assembly work.

Also, the resin spring can be in arcuate form with a convex curve extending outward of the contact surface of the case.

With this structure, the resin spring assumes an arcuate form with a convex curve, and therefore an effective elastic force can be generated with a simple geometry for an improved vibration absorption characteristic.

Also, the case can be used for housing an integrated connector unit containing a multiplicity of connectors.

With this structure, since a multiplicity of connectors are concentrated in a case, the case can be mounted in such a manner as to reduce the overall vibrations transmitted to the connectors collectively.

Further, the onboard unit may be an automatic transmission unit of the automobile, and the connector may fit on the connector of the solenoid valve mounted in the automatic transmission unit.

With this structure, the connector can be protected from both the vibrations due to the automatic transmission unit and the vibrations generated by the operation of the solenoid valve.

DESCRIPTION OF THE PREFERRED EMBODIMENTS

An embodiment of the present invention will be described below with reference to the accompanying drawings. According to this embodiment, a multiplicity of connectors are integrated in a single case to constitute an integrated connector unit. This integrated connector unit is mounted on the automatic transmission unit as an onboard unit.

Figure 1A:
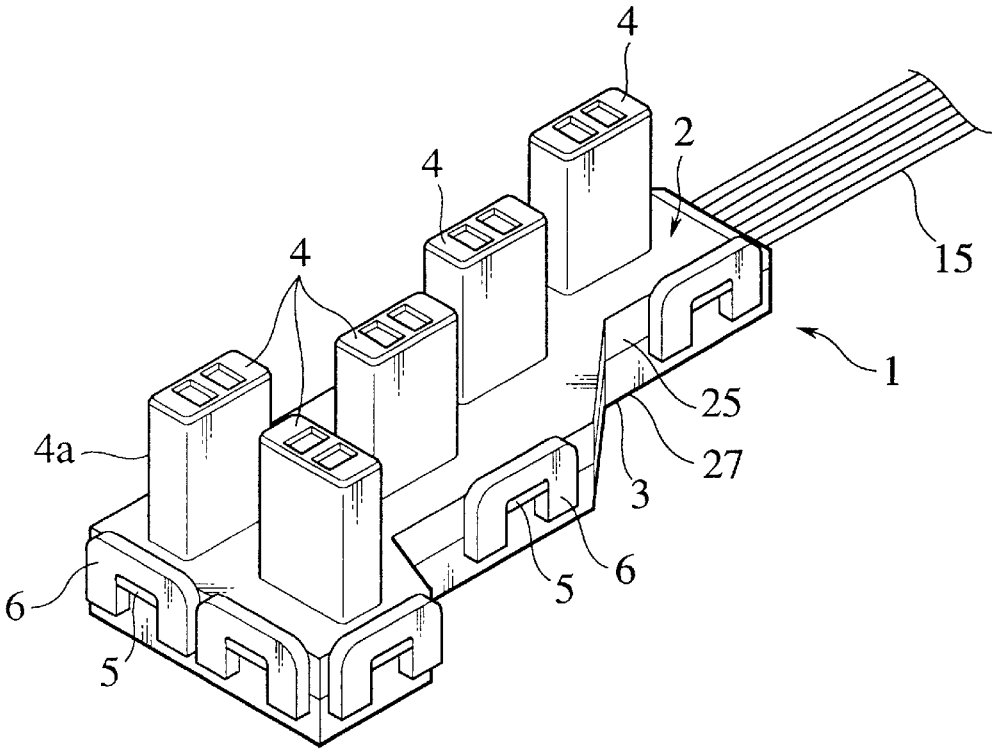
FIG. 1A is a perspective view of an integrated connector unit according to an embodiment of the invention.
Figure 1B:
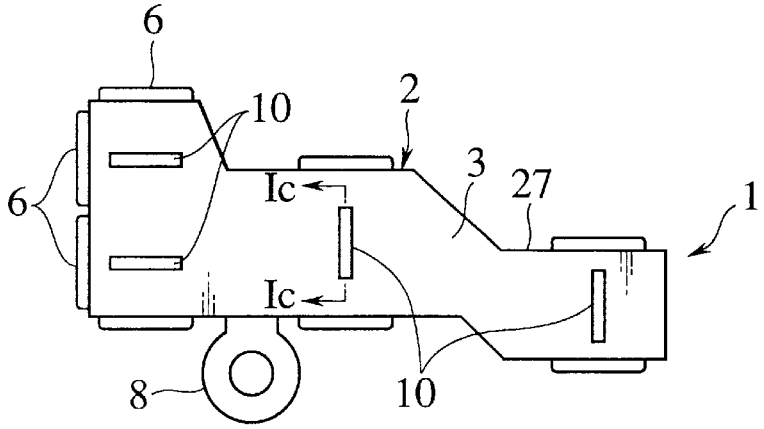
FIG. 1B is a bottom view of the integrated connector unit shown in FIG. 1A.
Figure 1C:
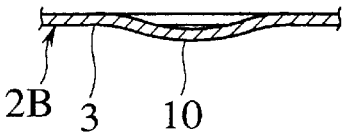
FIG. 1C is a sectional view taken in line Ic—Ic in FIG. 1B.
Figure 2A:
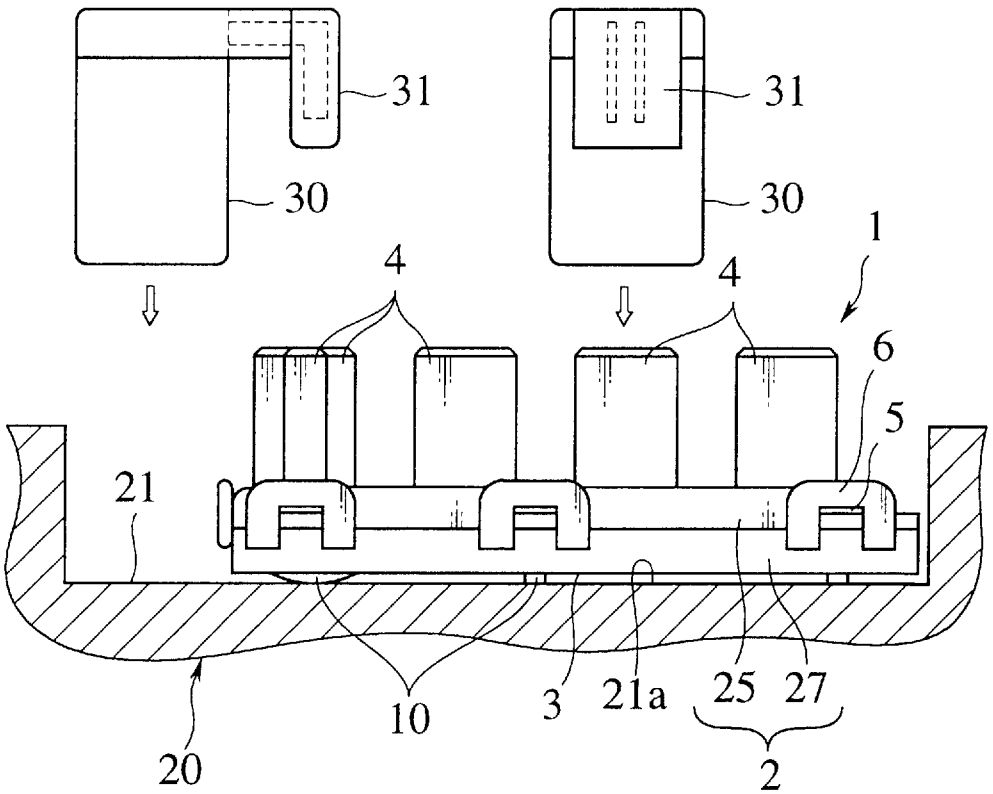
FIG. 2A is a front view of a structure for mounting an integrated connector unit according to an embodiment of the invention.
Figure 2B:
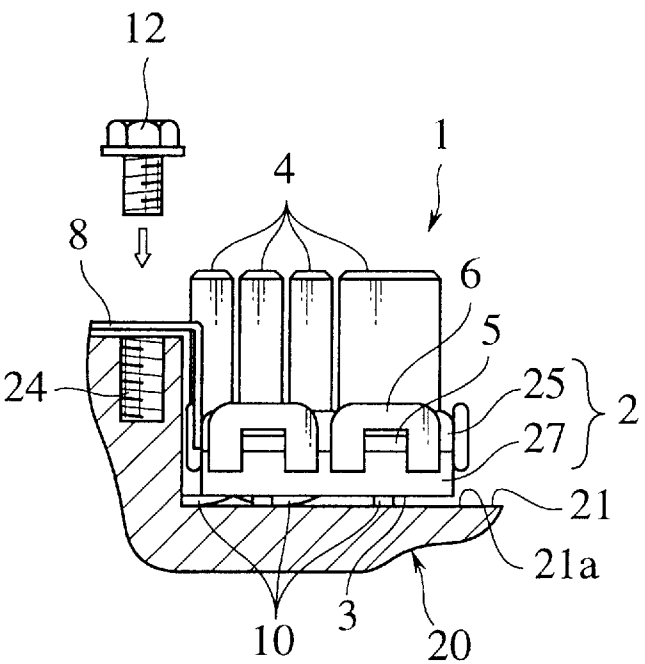
FIG. 2B is a side view of a structure for mounting an integrated connector unit according to an embodiment of the invention.
Figure 3:
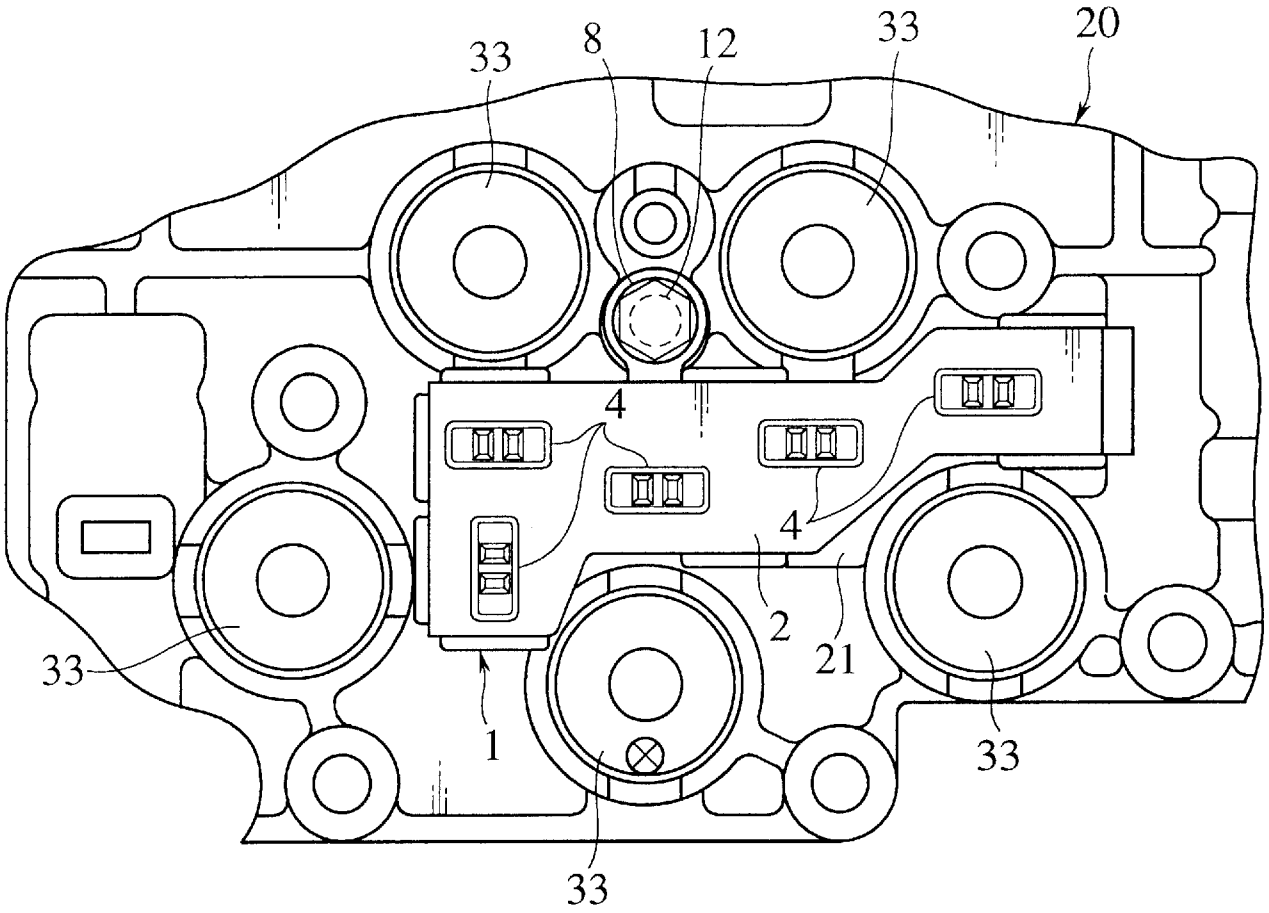
FIG. 3 is a plan view of a structure for mounting an integrated connector unit according to an embodiment of the invention.

FIG. 1A is a perspective view of an integrated connector unit 1, FIG. 1B is a bottom view thereof, FIG. 1C is a sectional view taken in line Ic—Ic in FIG. 1B, and FIGS. 2 and 3 are diagrams showing a structure for mounting the integrated connector unit 1 on the automatic transmission unit 20.

The integrated connector unit 1, which, as shown in FIG. 2A, is installed on a connector holder 21 of the automatic transmission unit 20, is for connecting a solenoid valve (unit) 30 of the automatic transmission unit 20 and a wire harness 15 on the vehicle body (FIG. 1A) electrically to each other. The integrated connector unit 1 includes a thin case 2 formed with resin. The case 2 has a polygonal shape based on a substantial rectangle in plan view. The case 2 includes a case body 25 and a cover 27 applied to the lower surface of the case body 25. The case body 25 and the cover 27 have the outer peripheral surface thereof formed with a plurality of lock protrusions and a plurality of lock frame 6, respectively, adapted to be interlocked with each other. The case body 25 and the cover 27 are locked in coupled relation to each other by means of the lock protrusions 5 and the lock frames 6. An internal space low in height for accommodating wirings is formed between the face plates of the case body 25 and the cover 27.

The face plate of the case body 25 is formed integrally with a plurality of cylindrical connector housing 4*a* protruded in the direction away from the side there thereof to be coupled with the cover 27. The connector housings 4*a* are formed respectively at positions easily connectable with the connectors on the solenoid valve. The terminal casing of each connector housing 4*a* contains a female connector terminal (not shown). The connector housing 4*a* and the connector terminal contained therein make up a connector (male connector) 4 to fit with the connector (female connector) 31 on the solenoid valve 30, as shown in FIG. 2A.

Also, as shown in FIG. 1B, the cover 27 has the bottom (contact surface) 3 thereof discretely formed with a plurality of resin springs 10 integrally with the cover 27. Each resin spring 10 assumes an arcuate form with a convex curve protruded outward of the bottom 3 of the cover 27, and therefore provides the lower surface 3 with an appropriate elasticity in vertical direction. Also, the case 2 includes an earth terminal fitting 8 doubling as a fitting used for mounting the integrated connector unit 50.

The integrated connector unit 1 having this configuration is mounted on the automatic transmission unit 20 as shown in FIGS. 2 and 3. Specifically, the integrated connector unit 1 is mounted with the resin springs 10 of the lower surface 3 of the cover 27 in contact with the upper surface (contact surface) 21*a* of the connector holder 21 of the casing of the automatic transmission unit 20. The earth terminal fitting 28 protruded outward of the case 2 of the integrated connector unit 1 is fastened by at least a bolt 12 into a threaded hole 24 of the casing, thereby fixing the integrated connector unit 1 to the automatic transmission unit 20. The resin springs 10 each making up an elastic member are interposed between the lower surface 3 of the integrated connector unit 1 and the upper surface 21*a* of the automatic transmission unit 20 for absorbing the vibrations transmitted from the automatic transmission unit 20.

After the integrated connector unit 1 is mounted, the connectors 31 of the solenoid valve 30 assembled on the automatic transmission unit 20 are fitted on the connectors 4 of the integrated connector unit 1. In this way, each solenoid valve 30 can be completely connected with the wire harness 15 (FIG. 1A). Reference numeral 33 in FIG. 3 designates the containers of the solenoid valves 30.

In the case where the integrated connector unit 1 is mounted in this fashion, the presence of the resin springs 10 capable of absorbing vibrations between the contact surfaces of the case 2 of the integrated connector unit 1 and the automatic transmission unit 20 can protect the connectors 4 from the vibrations of the automatic transmission unit 20 and the solenoid valve 30, thereby reducing the adverse effect of the vibrations on the connected portions of the connectors. Especially in this embodiment, since the resin springs 10 integrated with the case 2 are used as the elastic member functioning to absorb vibrations, it is possible to set the elastic member in position simply by installing the integrated connector unit 1 without any need of a special procedure for handling the parts of the elastic member. Also, since each resin spring 10 has an arcuate form curved outward in convex, the cover 27 can be readily formed of resin. As a result, an effective elastic function can be obtained while at the same time providing a sufficient vibration absorption capability.

Although the resin springs 10 integrated with the case 2 are used as an elastic member capable of absorbing vibrations according to this embodiment, other elastic members (such as a rubber plate) can alternatively be used as a vibration absorber in place of the resin springs 10 with equal effect. Also, apart from the present embodiment in which the integrated connector unit 1 is mounted on the automatic transmission unit 20, the same effect of vibration absorption can be obtained also by mounting the integrated connector unit 1 on other onboard units than the automatic transmission unit 20. Also, instead of the form of the integrated connector unit 1 having a plurality of connectors, the vibration absorption effect can be obtained for the case having a single connector by forming a resin spring 10 on the lower surface thereof.

What is claimed is:

1. A connector mounting structure comprising:

a resin mold case including at least one connector for electrical connection and mounted on a vehicle onboard unit; and at least one resin spring elastic member integrally formed with said case and having a vibration absorption function arranged in contact between said case and said onboard unit has been inserted before the period.

2. A connector mounting structure according to claim 1, wherein said case is associated with an integrated connector unit including a multiplicity of connectors.

3. A connector mounting structure according to claim 1, wherein said onboard unit is an automatic transmission unit of an automotive vehicle, and said connector is fitted with the connector of a solenoid valve mounted on said automatic transmission unit.

* * * * *

UNITED STATES PATENT AND TRADEMARK OFFICE

CERTIFICATE OF CORRECTION

PATENT NO. : 5,876,235
DATED : March 2, 1999
INVENTOR(S) : Yoshigi

It is certified that error appears in the above-identified patent and that said Letters Patent is hereby corrected as shown below:

Title Page, in the Attorney, Agent, or Firm, line 2, "Garnett" should read --Garrett--.

Claim 1, column 4, line 32, "unit has been inserted before period" should read --unit, said resin spring having a convex, arcuate form curved outwardly from said contact surface of said case.--

Signed and Sealed this

Thirtieth Day of November, 1999

*Attest:*

*Attesting Officer*

Q. TODD DICKINSON

*Acting Commissioner of Patents and Trademarks*